US007607902B2

(12) United States Patent
Onoda

(10) Patent No.: US 7,607,902 B2
(45) Date of Patent: Oct. 27, 2009

(54) CLOSED COMPRESSOR AND REFRIGERATING CYCLE APPARATUS

(75) Inventor: Izumi Onoda, Fuji (JP)

(73) Assignee: Toshiba Carrier Corporation, Tokyo (JP)

( * ) Notice: Subject to any disclaimer, the term of this patent is extended or adjusted under 35 U.S.C. 154(b) by 0 days.

(21) Appl. No.: 12/035,199

(22) Filed: Feb. 21, 2008

(65) Prior Publication Data

US 2008/0206082 A1 Aug. 28, 2008

Related U.S. Application Data

(63) Continuation of application No. PCT/JP2006/316619, filed on Aug. 24, 2006.

(30) Foreign Application Priority Data

Aug. 25, 2005 (JP) ..... 2005-244330

(51) Int. Cl.
*F03C 2/00* (2006.01)
*F03C 4/00* (2006.01)
*F04C 2/00* (2006.01)

(52) U.S. Cl. ..... 418/23; 418/11; 418/60; 418/69; 418/270; 417/218; 417/310

(58) Field of Classification Search ..... 418/11, 418/29, 23, 60, 69, 57; 417/310, 218, 221, 417/223, 287, 298, 410.3
See application file for complete search history.

(56) References Cited

U.S. PATENT DOCUMENTS

| | | | | |
|---|---|---|---|---|
| 5,050,233 | A * | 9/1991 | Hitosugi et al. | 417/427 |
| 5,094,085 | A * | 3/1992 | Irino | 62/175 |
| 2005/0063849 | A1 * | 3/2005 | Cho et al. | 418/23 |
| 2005/0112009 | A1 | 5/2005 | Lee et al. | |
| 2006/0002809 | A1 | 1/2006 | Kawabe et al. | |

FOREIGN PATENT DOCUMENTS

| | | | | |
|---|---|---|---|---|
| CN | 1621693 | A | 6/2005 | |
| EP | 1605167 | A1 | 12/2005 | |
| JP | 1-247786 | A | 10/1989 | |
| JP | 01247786 | A * | 10/1989 | 418/11 |
| JP | 5-172076 | | 7/1993 | |
| JP | 10259787 | A * | 9/1998 | |

(Continued)

OTHER PUBLICATIONS

English Abstract of JP-2005-171848 A.

(Continued)

*Primary Examiner*—Theresa Trieu
(74) *Attorney, Agent, or Firm*—DLA Piper LLP (US)

(57) ABSTRACT

A closed compressor includes a closed case in which a plurality of compression mechanism sections are accommodated, the compression mechanism section having a cylinder including a cylinder chamber eccentrically rotatably accommodating a roller, the compression mechanism section including a blade having a leading edge to divide the cylinder chamber into two parts along a direction in which the roller rotates, the compressor including a high-pressure refrigerant introducing mechanism guiding a high-pressure refrigerant into the cylinder chamber and separating the blade from the roller, the compressor being configured to switch between a high-capacity operation in which all the compression mechanism sections perform a compression operation and a low-capacity operation in which the blade in the compression mechanism section is separated from the roller and thus prevented from performing the compression operation, the high-pressure refrigerant introducing mechanism including a high-pressure refrigerant storage section storing the high-pressure refrigerant.

6 Claims, 8 Drawing Sheets

FOREIGN PATENT DOCUMENTS

| | | | |
|---|---|---|---|
| JP | 2004-301114 | A | 10/2004 |
| JP | 2005-155609 | A | 6/2005 |
| JP | 2005-171848 | A | 6/2005 |
| WO | WO-2004/083642 | A1 | 9/2004 |

OTHER PUBLICATIONS

English translation of JP-2005-155609 A.
English translation of CN-1621693 A.
English translation of JP-2004-301114 A.
English translation of WO-2004/083642 A1.
Japanese translation of Applicant's comment on JP-172076.
English translation of Applicant's comment on JP-172076.
Search Report from International Application No. PCT/JP2006/316619.
English Abstract of WO 2007/023904.
International Preliminary Report on Patentability, mailed Mar. 14, 2008, issued in counterpart application PCT/JP2006/316619.

* cited by examiner

CLOSED COMPRESSOR AND REFRIGERATING CYCLE APPARATUS

CROSS REFERENCE TO RELATED APPLICATIONS

This is a Continuation Application of PCT Application No. PCT/JP2006/316619, filed Aug. 24, 2006, which was published under PCT Article 21(2) in Japanese.

This application is based upon and claims the benefit of priority from prior Japanese Patent Application No. 2005-244330, filed Aug. 25, 2005, the entire contents of which are incorporated herein by reference.

BACKGROUND OF THE INVENTION

1. Field of the Invention

The present invention relates to a rotary closed compressor constituting a refrigerating cycle in, for example, an air conditioner, and a refrigerating cycle apparatus comprising the closed compressor.

2. Description of the Related Art

In recent years, efforts have been made to standardize a 2-cylinder type rotary closed compressor comprising two cylinders arranged in a vertical direction and constituting a compressing mechanism section. Specifications for such a compressor can advantageously be expanded if the compressor can be equipped with a cylinder chamber that always performs a compressing operation and a cylinder chamber that makes it possible to switch between a compression operation and a non-compression operation corresponding to shutdown depending on a difference in load.

The present applicant has thus provided a closed compressor comprising two cylinder chambers and means for increasing the pressure in one of the cylinder chambers to forcibly hold a vane (blade) away from a roller to suspend the compression operation in the cylinder chamber, as well as a refrigerating cycle apparatus comprising the compressor, as disclosed in, for example, Jpn. Pat. Appln. KOKAI Publication No. 2004-301114.

BRIEF SUMMARY OF THE INVENTION

Specifically, a compressed refrigerant gas is discharged into a closed case to increase the pressure in the case. Vanes are provided in a cylinder chamber accommodating an eccentric roller. One of the vanes is pressed and biased by a spring member. The pressure in a vane chamber for the other vane is set equal to the pressure in the case. A high or low pressure is introduced into the cylinder chamber with the vanes so that the vanes are or are not pressed and biased depending on a difference in pressure between the cylinder chamber and the vane chamber.

This configuration allows the structure for pressing and biasing the vanes to be simplified and also makes it possible to easily change from a high- to a low-capacity operation. However, the capacity switching operation is possible only during a continuous compression operation. That is, during shutdown, the pressures in the refrigerating cycle are balanced, preventing a high pressure from being introduced into the particular cylinder chamber. This in turn prevents the blades from being pressed and biased.

Furthermore, a compressor having an inverter device controlling operational frequency is operated at a low frequency to allow the blades to slide at low speed, enabling the capacity to be switched in a zone with a weak blade inertia force. However, a compressor driven by a commercial power supply needs to switch the capacity at 50 or 60 Hz. In this case, disadvantageously, owing to the high sliding speed and strong inertia force of the blades, the blade separated from a roller is likely to collide against the bottom of the blade chamber, bounce back, and then collide against the roller, making a collision sound.

The present invention is based on these circumstances. An object of the present invention is to provide a closed compressor comprising a high-pressure refrigerant storage section that stores a high-pressure refrigerant and using the minimum required control to enable a high-capacity operation condition to be switched to a low-capacity operation condition not only during operation but also during shutdown to allow stable operation switching, thus preventing possible noise such as a collision sound to allow silent operations, and to provide a refrigerating cycle apparatus comprising the closed compressor.

The closed compressor according to the present invention includes a closed case in which an electric motor section and a first compression mechanism section and a second compression mechanism section are accommodated, each of the first and second compression mechanism sections having a cylinder including a cylinder chamber eccentrically rotatably accommodating a roller, the cylinder including a blade which has a leading edge pressed and urged so as to abut against a peripheral surface of the roller to divide the cylinder chamber into two parts along a direction in which the roller rotates, the compressor including a high-pressure refrigerant introducing mechanism for guiding a high-pressure refrigerant into the cylinder chamber and separating the blade from the roller in the second compression mechanism section, the compressor being configured to switch between a high-capacity operation in which all the compression mechanism sections perform a compression operation and a low-capacity operation in which the blade in the second compression mechanism section is separated from the roller and thus prevented from performing the compression operation, depending on a difference in load, the high-pressure refrigerant introducing mechanism including a high-pressure refrigerant storage section storing the high-pressure refrigerant.

The refrigerating cycle apparatus according to the present invention includes the closed compressor, a condenser, an expansion device, and an evaporator to constitute a refrigerating cycle circuit.

DETAILED DESCRIPTION OF THE INVENTION

An embodiment of the present invention will be described with reference to the drawings.

Figure 1:
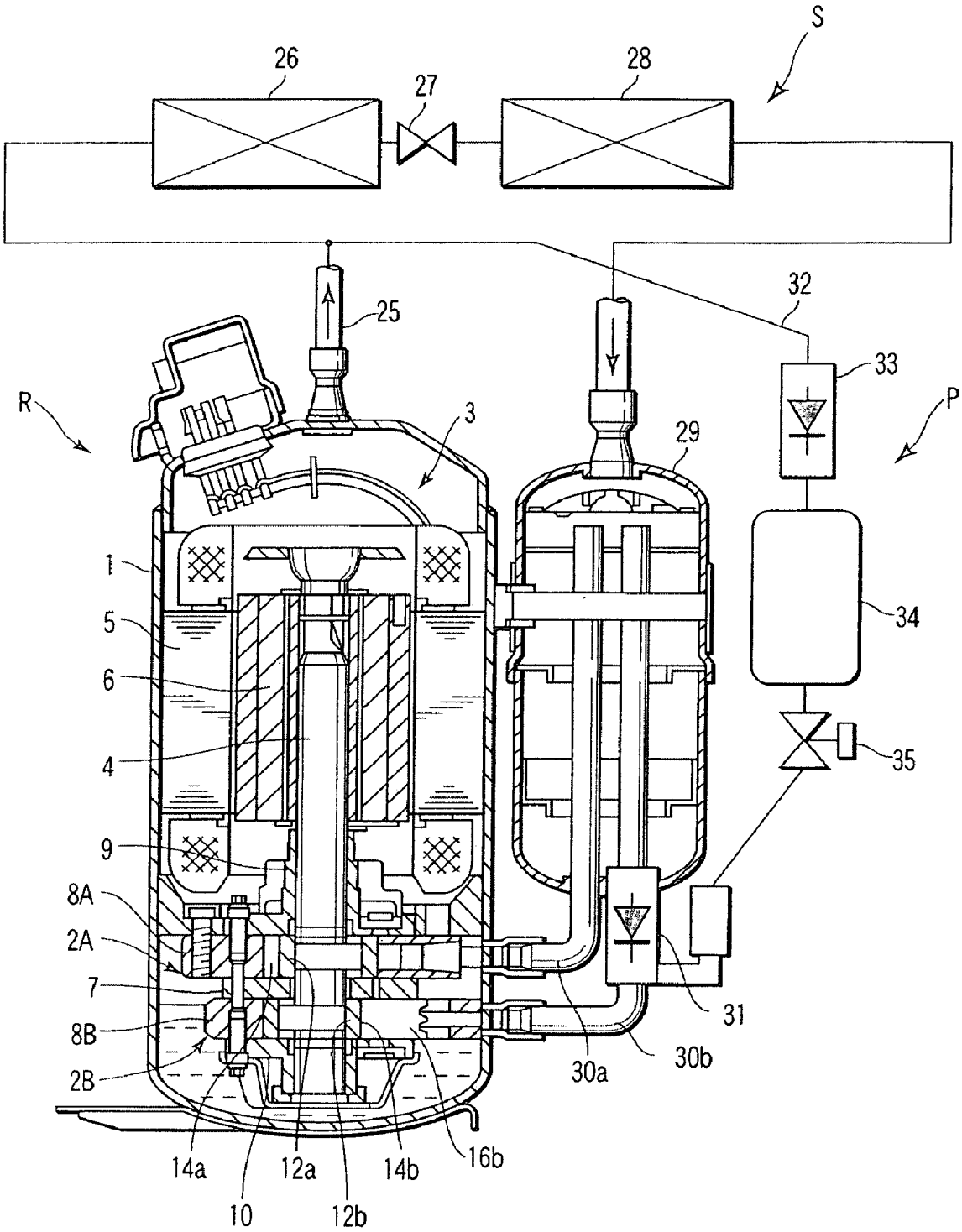
FIG. 1 is a vertical sectional view showing a closed compressor according to an embodiment of the present invention as well as the configuration of a refrigerating cycle.

FIG. 1 is a diagram showing the sectional structure of a rotary closed compressor R and the configuration of a refrigerating cycle in a refrigerating cycle apparatus comprising the closed compressor R (to avoid complicatedness, some components are not denoted by reference numbers; this also applies to the other drawings).

First, the closed compressor R will be described. Reference number 1 denotes a closed case having a first compression mechanism section 2A and a second compression mechanism section 2B installed in a lower part and described below, and an electric motor section 3 installed in an upper part. The electric motor section 3 is coupled to the first and second compression mechanism sections 2A and 2B via a rotating shaft 4.

The electric motor section 3 is composed of a stator 5 fixed to an inner surface of the closed case 1 and a rotor 6 located inside the stator 5 with a predetermined gap between the rotor 6 and the stator 5 and fitted around the rotating shaft 4.

Each of the first and second compression mechanism sections 2A and 2B comprises a first cylinder 8A and a second cylinder 8B disposed around the lower part of the rotating shaft 4 and arranged in a vertical direction via an intermediate partition plate 7. The first and second cylinders 8A and 8B are set to have different outside dimensions and the same inner diameter dimension.

A main bearing 9 is placed or a top surface part of the first cylinder 8A and attached to the first cylinder 8A via mounting bolts together with a valve cover. A sub-bearing 10 is placed on a bottom surface part of the second cylinder 8B and attached to the second cylinder 8B via mounting bolts together with a valve cover.

The intermediate partition plate 7 and the sub-bearing 10 have outer diameter dimensions greater than the inner diameter of the second cylinder 8B to some degree. The inner diameter position of the cylinder 8B is displaced from the center of the cylinder. Thus, the outer circumference of the second cylinder 8B partly projects from the outer diameters of the intermediate partition plate 7 and the sub-bearing 10 in a radial direction.

On the other hand, the rotating shaft 4 is rotatably pivoted by the main bearing 9 and the sub-bearing 10 at a middle part and at a lower end, respectively. Moreover, the rotating shaft 4 penetrate the cylinders 8A and 8B and integrally comprises two eccentric parts formed with a phase difference of about 180°. The eccentric parts have the same diameter and are assembled so as to be positioned in the inner diameter part of each of the cylinders 8A and 8B. Eccentric rollers 12*a* and 12*b* are fitted around peripheral surfaces of the respective eccentric parts.

A top surface and a bottom surface of each of the first cylinder 8A and the second cylinder 8B are defined by the intermediate partition plate 7, the main bearing 9, and the sub-bearing 10 so as to form a first cylinder chamber 14*a* and a second cylinder chamber 14*b* inside the first cylinder 8A and the second cylinder b8B, respectively. The first and second cylinder chambers 14*a* and 14*b* are formed to have the same diameter and height dimension and eccentrically rotatably accommodate the eccentric rollers 12*a* and 12*b*, respectively.

The eccentric rollers 12*a* and 12*b* are formed to have substantially the same height dimension as that of the first and second cylinder chambers 14*a* and 14*b*. Thus, although the eccentric rollers 12*a* and 12*b* have a phase difference of 180° between the eccentric rollers 12*a* and 12*b*, the eccentric rollers 12*a* and 12*b* are set to have the same excluded volume in the cylinder chambers 14*a* and 14*b* owing to eccentric rotations in the cylinder chambers 14*a* and 14*b*, respectively.

Figure 2:
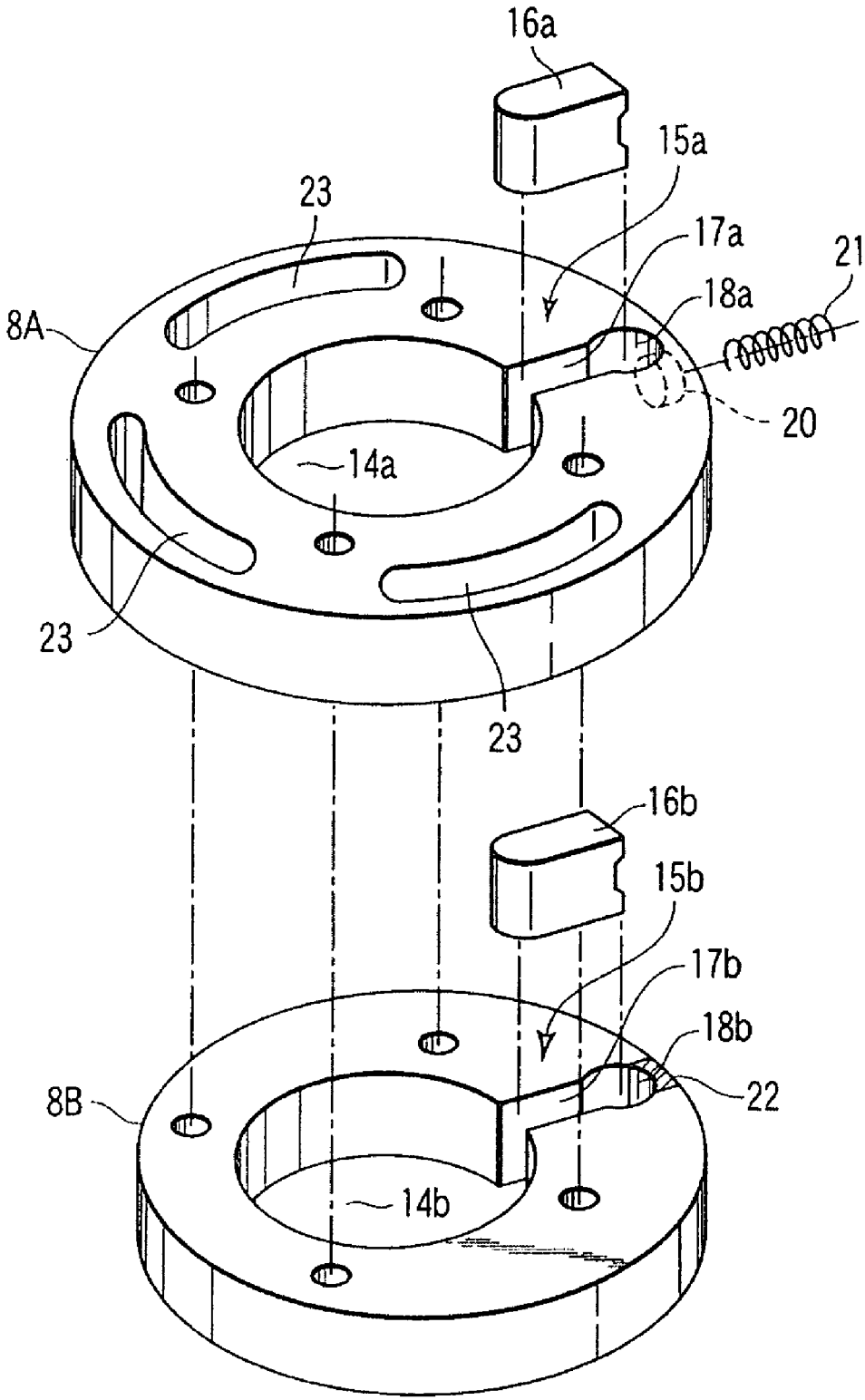
FIG. 2 is a perspective view showing a first compression mechanism section and a second compression mechanism section according to the embodiment each of which is partly disassembled.

FIG. 2 is a perspective view showing the first compression mechanism section 2A and second compression mechanism section 2B, each of which is partly disassembled.

The first cylinder 8A and the second cylinder 8B have blade chambers 15*a* and 15*b*, respectively, which are in communication with the first and second cylinder chambers 14*a* and 14*b*, respectively. The blade chambers 15*a* and 15*b* accommodate blades 16*a* and 16*b*, respectively, so that leading ends of the blades 16*a* and 16*b* can project into and withdraw from the first and second cylinders 14*a* and 14*b*, respectively.

Each of the blade chambers 15*a* and 15*b* is made up of a blade housing groove 17*a*, 17*b* through which opposite side surfaces of the blade 16*a*, 16*b* can move slidably, and a vertical hole part 18*a*, 18*b* integrally connected to an end of the blade housing groove and in which a trailing end of the blade 16*a*, 16*b* is accommodated. In particular, the first cylinder 8A has a horizontal hole 20 through which an outer peripheral surface of the first cylinder 8A is in communication with the blade chamber 15*a* and in which a spring member 21 is accommodated. The spring member 21 is interposed between a trailing end surface and an inner peripheral surface of the closed case 1 to apply an elastic force (back pressure) to the blade 16*a* to elastically contact the leading end of the blade 16*a* with a peripheral surface of the eccentric roller 12*a*.

No member other than the blade 16*a* is accommodated in the blade chamber 15*b* in the second cylinder 8B. The leading end of the blade 16*b* is or is not contacted with the peripheral surface of the eccentric roller 12*b* depending on a set environment for the blade chamber 15*b* and the operation of a high-pressure refrigerant introducing mechanism (high-pressure refrigerant introducing means) P as described below.

The leading ends of the blades 16*a* and 16*b* are formed to be semicircular as seen in a plan view and can thus linearly contact the peripheral surfaces of the eccentric rollers 12*a* and 12*b*, respectively, regardless of the rotation angles of the eccentric rollers. When the eccentric roller 12*a*, 12*b* rotates eccentrically along an inner peripheral wall of the first or second cylinder chamber 14*a* or 14*b*, the blade 16*a*, 16*b* reciprocates along the blade housing groove 17*a*, 17*b* to partition the first or second cylinder chamber 14*a* or 14*b* into a suction chamber and a compression chamber. The trailing end of the blade 16*a*, 16*b* can advance into and withdraw from the vertical hole part 18*a*, 18*b*.

Owing to the relationship between the outside dimensions of the second cylinder 8B and the outside dimensions of the intermediate partition plate 7 and the sub-bearing 10, the external shape of the second cylinder is partly exposed into the closed case 1. The compressor is designed so that the part of the second cylinder 8B exposed into the closed case 1 corresponds to the blade chamber 15*b*. Consequently, the trailing ends of the blade chamber 15*b* and the blade 16*b* are subjected directly to the in-case pressure.

In particular, the second cylinder 8B and the blade chamber 15*b* are structures and are not affected by the in-case pressure. However, since the blade 16*b* is slidably accommodated in the blade chamber 15*b* and the trailing end of the blade 16*b* is positioned in the vertical hole part 18*b* of the blade chamber 15*b*, the blade 16*b* is subjected directly to the in-case pressure.

Moreover, the leading end of the blade 16*b* lies opposite the second cylinder chamber 14*b* and is thus subjected to the pressure in the second cylinder chamber 14*b*. Consequently, the blade 16*b* is configured so that depending on the difference between pressure exerted on the leading end of the blade 16*b* and the pressure exerted on the trailing end of the blade 16*b*, the blade 16*b* moves from the high-pressure part to the low-pressure part.

A holding mechanism 22 is provided adjacent to the vertical hole part 18*b* in the blade chamber 15*b* in the second cylinder 8B. The holding mechanism 22 biases the leading end of the blade 16*b* away from the eccentric roller 12*b*. Additionally, the holding mechanism 22 always exerts a fixed biasing force on the blade 16*b*. However, the leading end of the blade 16*b* is or is not contacted with the peripheral surface of the eccentric roller 12*b* depending on the level of the difference between the suction pressure exerted on the second cylinder chamber 14*b*, in which the leading end of the blade 16*b* is positioned, and the pressure in the closed case 1 which is exerted on the blade chamber 15*b*, in which the trailing end of the blade 16*b* is positioned.

Providing the holding mechanism 22 with a permanent magnet enables the blade 16*b* to be always magnetically attracted at a predetermined force. Alternatively, instead of the permanent magnet, an electromagnet may be provided in the holding mechanism 22 so as to perform magnetic attraction as required, or one end of a tension spring that is an elastic body may be engaged with the leading end of the blade 16*b* to always tensely bias the blade 16*b* at a predetermined elastic force.

Mounting holes or screw holes are formed in each of the cylinders 8A and 8B so that the mounting bolts can be inserted or threadably inserted through the holes. A circular gas passing hole part 23 is formed only in the first cylinder 8A.

Referring back to FIG. 1, the rotary closed compressor R configured as described above is incorporated into a refrigerating cycle circuit S in a refrigerating cycle apparatus. That is, a discharge pipe 25 is connected to an upper end of the closed case 1 and connects to an accumulator 29 via a condenser 26, an expansion mechanism (expansion device) 27, and an evaporator 28 which are arranged in this order.

A first suction pipe 30*a* and a second suction pipe 30*b* projecting from the bottom of the accumulator 29 and are connected to the compressor R. Additionally, the first suction pipe 30*a* penetrates the closed case 1 and is in direct communication with the interior of the first cylinder chamber 14*a* via a suction hole formed in the first cylinder 8A. The second suction pipe 30*b* has a first check valve 31 in a middle part, penetrates the closed case 1, and is in direct communication with the interior of the second cylinder chamber 14*b* via a suction hole formed in the second cylinder 8B.

The closed compressor R comprises the high-pressure refrigerant introducing mechanism (high-pressure refrigerant introducing means) P. The high-pressure refrigerant introducing mechanism P comprises a high-pressure introducing pipe 32 one end of which is connected to the discharge pipe 25, extending from the closed case 1 and the other end of which is connected to a second suction pipe 30*b* extending between the accumulator 29 and the second cylinder 14*b*.

The high-pressure introducing pipe 32 has, in a middle part, a second check valve 33, a storage container 34 serving as a high-pressure refrigerant storage section, and an electromagnetic on-off valve 35 which arranged in this order so that the second check valve 33 lies closest to a connection with the discharge pipe 25. The other end of the high-pressure introducing pipe 32 is connected between the first check valve 31 in the second suction pipe 30*b* and a closed case 1 penetrating part.

The storage container 34 has a closed structure suitable for accommodating a gas refrigerant of an elevated pressure guided through the discharge pipe 25. The second check valve 33 is installed, as a fluid control valve, on an upstream side of the storage container 34, that is, an inlet side for the flow of the high-pressure refrigerant. The electromagnetic on-off valve 35 is installed on a downstream side or an outlet side of the storage container 34 as a fluid control valve.

Now, description will be given of the operation of the refrigerating cycle apparatus comprising the closed rotary compressor R, described above. As described below, the closed compressor can switch between a high-capacity operation (twin operation) and a low-capacity operation (single operation).

First, the high-capacity operation will be described. A control section sends an open signal to the electromagnetic on-off valve 35, constituting the high-pressure refrigerant introducing mechanism P. The control section also sends an operation start signal to the electric motor section 3. The rotating shaft 4 is rotationally driven to simultaneously actuate the first compression mechanism section 2A and the second compression mechanism section 2B.

The eccentric rollers 12*a* and 12*b* rotate eccentrically in the first and second cylinder chambers 14*a* and 14*b*, respectively. In the first compression mechanism section 2A, the blade 16*a* is always elastically pressed and biased by the spring member 21. The leading end of the blade 16*a* thus slidably contacts the peripheral surface of the eccentric roller 12*a* to divide the interior of the first cylinder chamber 14*a* into a suction chamber and a compression chamber.

The position where the eccentric roller 12*a* is rolling contact with the inner peripheral surface of the first cylinder chamber 14*a* coincides with the blade housing mechanism 17*a*. Withdrawing the blade 16*a* to the farthest position maximizes the spatial volume of the cylinder chamber. A refrigerant gas is sucked from the accumulator 29 into the first cylinder chamber 14*a* via the first suction port 30*a* to fill the first cylinder chamber 14*a*.

As the eccentric roller 12*a* rotates eccentrically, the position where the eccentric roller 12*a* is in rolling contact with the inner peripheral surface of the first cylinder chamber 14*a* moves to reduce the volume of the compression chamber, into which the cylinder chamber 14*a* has been divided. That is, the gas previously introduced into the cylinder chamber 14*a* is gradually compressed. The rotating shaft rotates continuously to further reduce the volume of the compression chamber in the first cylinder chamber 14*a* to compress the gas. When the pressure on the gas rises to a predetermined value, a discharge valve is opened. The high-pressure gas is discharged into the closed case 1 via the valve cover and fills the closed case 1. The gas is then discharged through the discharge pipe 25, provided at the top of the closed case.

Since the electromagnetic on-off valve 35, provided in the high-pressure introducing pipe 32, is closed, the high-pressure refrigerant guided to the high-pressure introducing pipe 32 through the discharge pipe 25 is further guided to the storage container 34 via the second check valve 33, where the further flow of the gas is inhibited. Thus, once a predetermined amount of high-pressure refrigerant is guided to and fills the storage container 34, no more high-pressure refrigerant is introduced into the storage container. The high-pressure refrigerant guided to the storage container 34 is inhibited from flowing backward, allowing a high pressure to be maintained in the storage container 34.

On the other hand, the high-pressure refrigerant guided to the discharge pipe 25 is condensed and liquefied in the condenser 26. The refrigerant is then adiabatically expanded in the expansion mechanism 27. The evaporator 28 draws vaporization latent heat from heat exchange air to perform a cooling operation. The evaporated refrigerant is guided to the accumulator 29, where the refrigerant is separated into a gas and a liquid. The gas and the liquid are then sucked into the first and second compression mechanism sections 2A and 2B through the first arid second suction pipes 30*a* and 30*b*, respectively.

Additionally, the low-pressure refrigerant separated into the gas and liquid by the accumulator 29 is guided to the first cylinder chamber 14*a*, corresponding to the first compression mechanism section 2A, through the first suction pipe 30*a*. The refrigerant is then compressed as the eccentric roller 12*a* rotates eccentrically. The resultant refrigerant is discharged to the interior of the closed case 1.

Furthermore, the second cylinder chamber 14*b* is set to have a suction-pressure (low-pressure) atmosphere by the low-pressure refrigerant guided to the second cylinder chamber 14*b*, corresponding to the second compression mechanism section 2B, through the second suction pipe 30*b* via the first check valve 31. On the other hand, the blade chamber 15*b* is exposed into the closed case 1 and thus set to have a discharge-pressure (high-pressure) atmosphere. This sets a low-pressure condition for the leading end of the blade 16*b*, while setting a high-pressure condition for the trailing end. This results in a difference in pressure between the leading end and the trailing end.

This differential pressure causes the leading end of the blade 16*b* to be pressed and biased so as to abut slidably against the eccentric roller 12*b*. The second cylinder 8B has the holding mechanism 22 to bias the blade 16*b* away from the eccentric roller 12*a*. However, the biasing force of the holding mechanism 22 is smaller than the differential pressure between the suction pressure in the second cylinder chamber 14*b* and the pressure in the closed case 1 exerted on the blade chamber 15*b*. This prevents the blade 16*b* from being affected by the holding mechanism 22.

Thus, the second cylinder chamber 14*b* is subjected to exactly the same compression effect as that exerted when the blade 16*a* in the first cylinder chamber 14*a* is pressed and biased by the spring member 21. Consequently, the closed compressor R performs a high-capacity operation of exerting the compression effect on both the first compression mechanism section 2A and the second compression mechanism section 2B.

Now, the low-capacity operation will be described. The compressor may be switched to the low-capacity operation during the high-capacity operation or the low-capacity operation may be started after the stoppage of the high-capacity operation.

The control section issues the open signal to the electromagnetic on-off valve 35 in the high-pressure introducing pipe 32. The control section also sends the operation start signal to the electric motor section 3. The normal compression effect is exerted on the first compression mechanism section 2A as described above. The closed case 1 is filled with the discharged high-pressure gas to increase the pressure in the closed case 1.

The high-pressure refrigerant filled in the closed case 1 is discharged from the discharge pipe 25 and partly guided to the condenser 26 for a refrigerating cycle operation. The remaining part of the high-pressure refrigerant divergently flows to the high-pressure introducing pipe 32 through the discharge pipe 25 and then guided to the storage container 34 via the second check valve 33.

In actuality, since a maximum storage amount of high-pressure refrigerant is stored during the high-capacity operation, when the low-capacity operation is started to open the electromagnetic on-off valve 35, the high-pressure refrigerant in the storage container 34 is immediately guided into the second cylinder chamber 14*b* via the second suction pipe 30*b*.

Thus, almost simultaneously with the start of the low-capacity operation, the second cylinder chamber 14*b* is set to have the high-pressure atmosphere. On the other hand, the blade chamber 15*b*, provided in the second cylinder 8B, remains in the same high-pressure condition as that of the interior of the closed case 1. As a result, both the leading and trailing ends of the blade 16*b* are subjected to the high pressure, eliminating the difference in pressure between the leading and trailing ends.

Thus, the blade 16*b* pushed away by the first rotation of the eccentric roller 12*b* remains stopped away from the outer peripheral surface of the eccentric roller 12*b*. The eccentric roller 12*b* rotates idly, and the second cylinder chamber 14*b* is not subjected to the compression effect, with the second compression mechanism section 2B set in a non-compression operation condition (also referred to as an idle cylinder condition). Consequently, only the compression effect on the first compression mechanism section 2A is active, that is, the low-capacity operation the level of which is half that of the high-capacity operation is performed.

Part of the high-pressure refrigerant guided to the high-pressure introducing pipe 32 starts to flow backward toward the interior of the accumulator 29 through the second suction pipe 30*b*. However, the first check valve 31, provided in the suction pipe 30*b*, inhibits the high-pressure refrigerant from flowing backward to the accumulator 29. Furthermore, the high pressure in the second cylinder chamber 14*b* prevents a compressed gas from leaking from the interior of the closed case 1 to the interior of the second cylinder 14*b*. This in turn prevents a possible resultant loss. Therefore, the lo-capacity operation can be performed without any decrease in compression efficiency.

Figure 3:
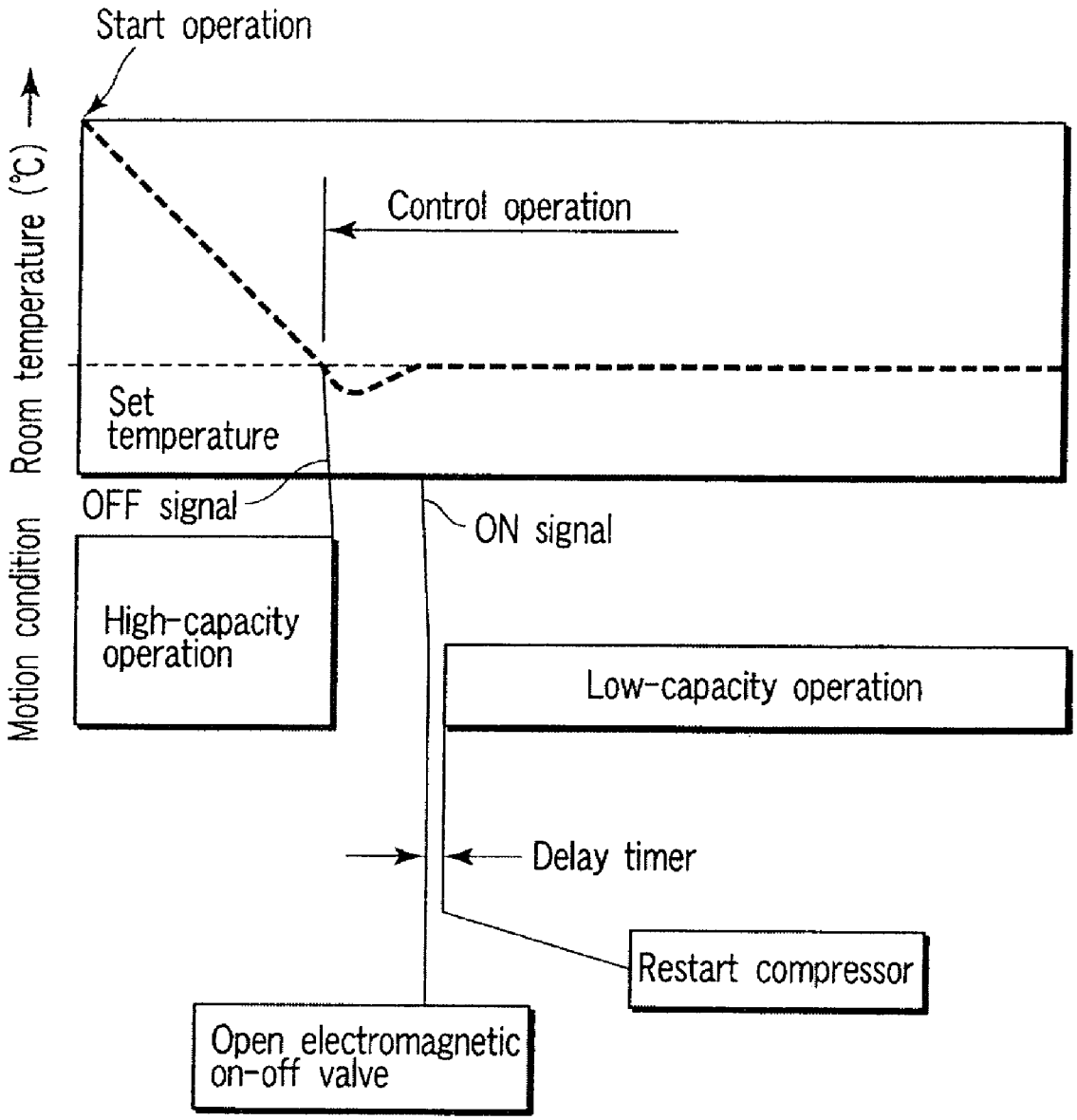
FIG. 3 is a characteristic diagram of a variation in room temperature and an operation pattern according to the embodiment.

FIG. 3 is a diagram showing the relationship between an actual operation pattern and a variation in temperature.

Here, the electric motor section 3, constituting the closed compressor R, is assumed to be driven by a commercial power supply. When an operation start button is pressed at a high room temperature, since at the beginning of the operation, a heavy air conditioning load is imposed on the compressor, which thus needs to provide a high capacity, the high-capacity operation (twin operation) is started in which the compression effect is exerted on the first and second cylinder chambers 14*a* and 14*b*.

Thus, the room temperature lowers rapidly to a set value. In this case, the electromagnetic on-off valve 35 in the high-pressure introducing pipe 32 is closed, with a maximum amount of high-pressure refrigerant stored in the storage container 34, as described above. When the room temperature lowers further below the set value, a thermo OFF signal is sent to the control section, which controllably stops the high-capacity operation. At this time a substantial control operation is started.

The room temperature lowers rapidly during the high-capacity operation. However, stopping the operation causes the room temperature to start rising. A certain time later, the raised temperature reaches a set value. At this timing, the control section controllably opens the electromagnetic on-off valve 35. The high-pressure refrigerant is immediately guided to the second cylinder chamber 14*b* via the electromagnetic on-off valve 35 and the second suction pipe 30*b*.

The interior of the closed case 1 and the second cylinder chamber 14*b* are set in substantially the same high-pressure atmosphere. The leading end of the blade 16*b* is subjected to the pressure in the second cylinder chamber 14*b*. The trailing end of the blade 16*b* is subjected to the pressure in the blade chamber 15*b*. The pressure condition at the leading end is balanced with the pressure condition at the trailing end.

Simultaneously with the opening of the electromagnetic on-off valve 35, the control section 35 actuates, for example, a delay timer. When a predetermined time set in the delay timer has passed since the electromagnetic on-off valve 35 was opened, the control section issues an ON signal to the electric motor section 3.

The rotating shaft 4 is thus rotationally driven to eccentrically rotate the eccentric roller 12*b*. This first rotation causes the blade 16*b* to be pushed and withdrawn to the blade housing chamber 17*b*. After the trailing end of the blade 16*b* comes into contact with the holding mechanism 22, the blade 16*b* is continuously suck and held by the holding mechanism 22.

No differential pressure is generated between the leading end and trailing end of the blade 16*b*, allowing the holding mechanism 22 to prevent the blade 16*b* from moving. The eccentric roller 12*b* rotates idly, preventing the second cylinder chamber 14*b* from being subjected to the compression effect. The compression effect is exerted only in the first cylinder chamber 14*a*, resulting in the 50% low-capacity operation as described above. At this time, the blade 16*b*, provided in the second cylinder 8B, remains sucked in the corresponding position. This prevents the blade 16B from colliding repeatedly against the second cylinder 8B to make a collision sound.

Thus, the closed compressor R comprises the high-pressure refrigerant introducing mechanism P, which guides the high-pressure refrigerant into the second cylinder chamber 14*b* and separates the blade 16*b* from the eccentric roller 12*b*. The high-pressure introducing pipe 32 comprises the storage container (high-pressure refrigerant storage section) 34 in which the high-pressure refrigerant is stored. Not only the compressor can be switched to the low-capacity operation during the high-capacity operation but also the low-capacity operation can be started a predetermined time after the stoppage of the high-capacity operation. In either case, the low-capacity operation can be stably started, allowing reliability to be improved.

During the low-capacity operation, the idle blade 16*b* in the second cylinder chamber 14*b* must be subjected to no (or a weak) blade spring force. However, with the compressor R, driven by the commercial power supply, if the blade is idle during the high-capacity operation, the blade 16*b* collides repeatedly against the bottom of the blade chamber 15*b* and the roller, disadvantageously making a collision sound. However, the above-described configuration and operation enables the idle blade 16*b* to be reliably fixed during the low-capacity operation, preventing a possible collision sound.

The high-capacity operation is started, and the room temperature lowers to the set value. The high-capacity operation is then stopped, and the room temperature rises to the set value again. The electromagnetic on-off valve 35 is opened and the delay timer is actuated to restart driving the electric motor section 3 on the basis of a signal from the delay timer.

That is, the electric motor section 3 is driven by setting the time to actuate the delay timer taking into account the time from the point at which the electromagnetic on-off valve 35 is opened to allow the high-pressure refrigerant to flow out of the storage container 34 until the high-pressure refrigerant is guided to the second cylinder chamber 14*b* via the electromagnetic on-off valve 35 and the second suction pipe 30*b* and the time required for the high-pressure refrigerant to fill the second cylinder chamber 14 so that no differential pressure is generated between the leading end and trailing end of the blade 16*b*.

Thus, the low-capacity operation is smoothly started, allowing operation switching to be reliably achieved to improve reliability.

The second suction pipe 30*b* has the first check valve 31, and the high-pressure refrigerant introducing mechanism P has the second check valve 33. However, slight leakage occurs unavoidably in the first and second check valves 31 and 33 because of the characteristics of the components of the valves. However, since the air conditioner always starts the operation at full capacity, stable switching can be achieved provided that the pressure can be maintained only until a restarting operation that needs to be performed at low capacity.

Figure 4:
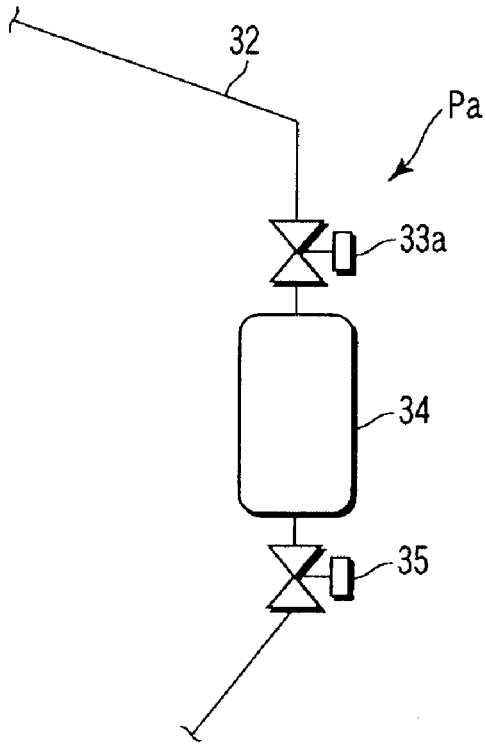
FIG. 4 is a diagram showing the configuration of a part of a high-pressure refrigerant introducing mechanism according to another embodiment.

A high-pressure refrigerant introducing mechanism Pa as shown in FIG. 4 may also be used (the same components as those described above are denoted by the same reference numbers and will not be described below; this also applies to the description below).

The high-pressure refrigerant introducing mechanism Pa has not only the electromagnetic on-off valve 35, serving as a fluid control valve, downstream of the storage container 34, provided in the high-pressure introducing pipe 32, but also an electromagnetic on-off valve 33*a* serving as a fluid control valve, upstream of the storage container 34.

Thus, the storage container 34 and the electromagnetic on-off valves 33*a* and 35, preceding and succeeding the storage container 34, enable the high-pressure refrigerant to be completely sealed between the valves. This improves the air-tightness of the storage container 34 and allows operation switching to be smoothly achieved even if the compressor is to be switched to the low-capacity operation after a long shutdown.

Figure 5:
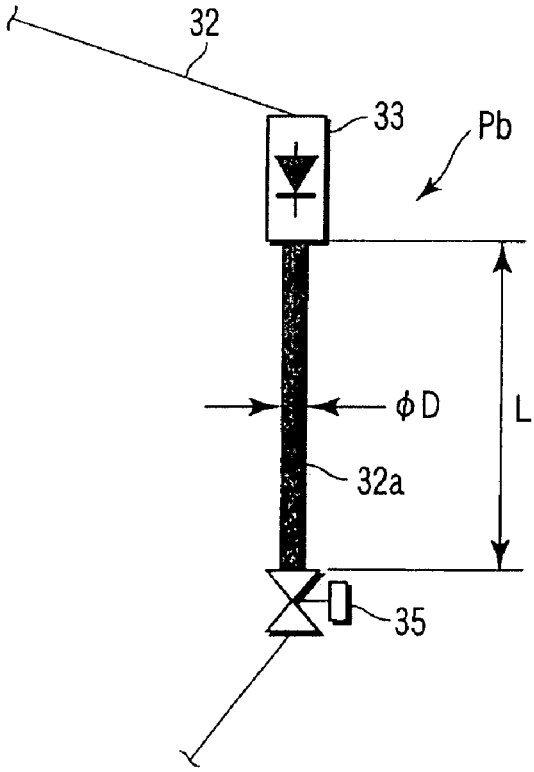
FIG. 5 is a diagram showing the configuration of a part of a high-pressure refrigerant introducing mechanism according to yet another embodiment.

A high-pressure refrigerant introducing mechanism Pb as shown in FIG. 5 may be used. Instead of the above-described storage container 34, a high-pressure refrigerant storage section may be used which has a high-pressure introducing pipe 32*a* of a greater diameter connecting the second check valve 32 and the electromagnetic on-off valve 35 together. With a volume V set greater than the excluded volume of the second cylinder chamber 14*b* on the basis of the diameter $\phi$D and length L of the high-pressure introducing pipe 32*a*, the high-pressure refrigerant storage section can produce such effects as described above instead of the storage container 34.

Figure 6:
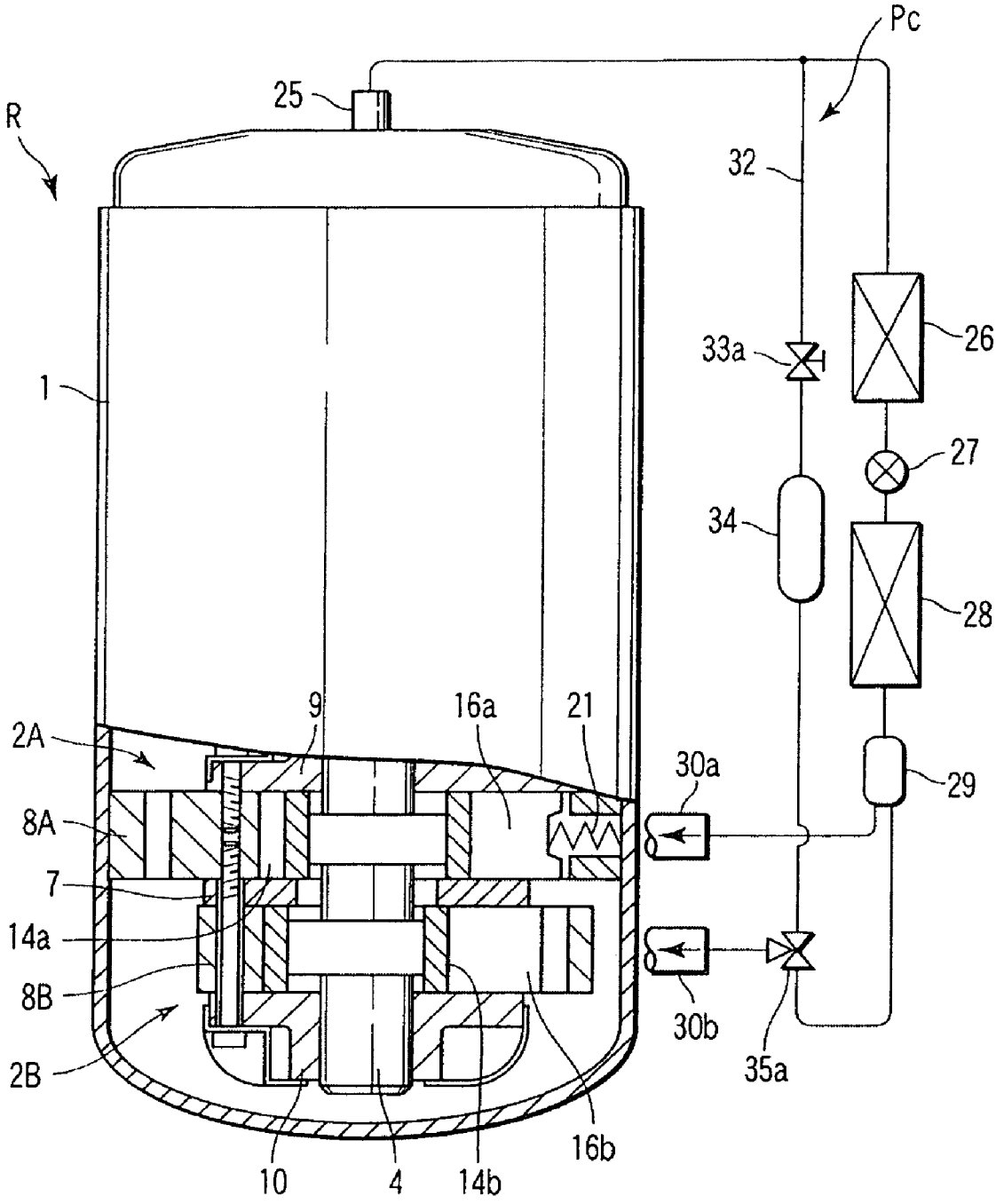
FIG. 6 is a partial vertical sectional view showing a closed compressor and the configuration of a refrigerating cycle according to still another embodiment.

A high-pressure refrigerant introducing mechanism Pc as shown in FIG. 6 may be used. The storage container 34, serving as the high-pressure refrigerant storage section, is provided in the high-pressure introducing pipe 32, which diverges from the discharge pipe 25. The electromagnetic on-off valve 33*a* (which may be the check valve 33), serving as a fluid control valve, is provided upstream of the storage container 34. A three-way selector valve 35*a* is provided downstream of the storage container 34 and connects to the middle part of the second suction pipe 30*b*, which is in communication with the accumulator 29.

The three-way selector valve 35*a* is applied to the high-pressure refrigerant introducing mechanism Pc as a fluid control valve. This enables the switching between the full-capacity operation and the low-capacity operation, described above, to be more smoothly achieved.

Figure 7:
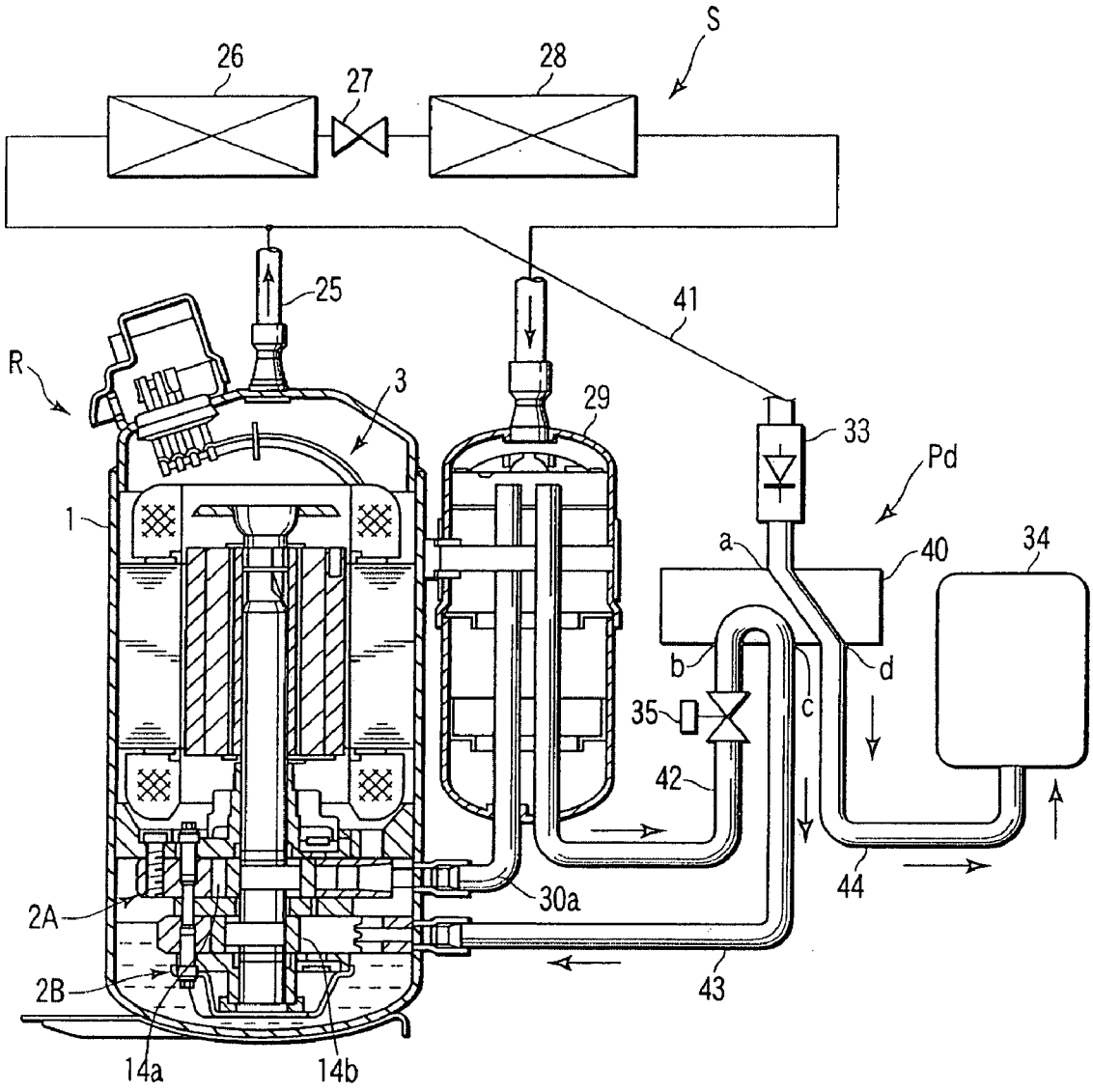
FIG. 7 is a partial vertical sectional view showing a closed compressor and the configuration of a refrigerating cycle according to still another embodiment.

A high-pressure refrigerant introducing mechanism (high-pressure refrigerant introducing means) Pd as shown in FIG. 7 may be used.

The high-pressure refrigerant introducing mechanism Pd comprises the storage container 34, serving as the high-pressure refrigerant introducing means, and a four-way selector valve 40. A first port a in the four-way selector valve 40 is in communication with a high-pressure side of the refrigerating cycle corresponding to the discharge pipe 25, through a high-pressure conduit 41 via the check valve 33. The high-pressure conduit 41 has the second check valve 33, serving as a fluid control valve.

A second port b in the four-way selector valve 40 is in communication with a low-pressure side of the refrigerating cycle corresponding to the accumulator 29, through a low-pressure conduit 42. The low-pressure conduit 42 has the electromagnetic on-off valve 35, serving as a fluid control valve. A third port c in the four-way selector valve 40 is in communication with the second cylinder chamber 14*b* in the second compression mechanism section 2B through a first conduit 43. A fourth port d in the four-way selector valve 40 is in communication with the storage container 34 via a second conduit 44.

In the closed container R and refrigerating cycle circuit S comprising the high-pressure refrigerant introducing mechanism Pd described above, during the high-capacity operation, the four-way selector valve 40 is controlled so as to allow the high-pressure conduit 41 and the second conduit 44 to communicate with each other, to allow the low-pressure conduit 42 and the first conduit 43 to communicate with each other, and to open the electromagnetic on-off valve 35.

The high-pressure refrigerant flows divergently from the discharge port 25 to the high-pressure conduit 41 is guided to the four-way selector valve 40 via the second check valve 33 and further to the storage container 34 via the second conduit 44 as shown by solid arrows in the figure. Consequently, the storage container 34 is filled with the high-pressure refrigerant and is set in a storage condition.

On the other hand, the low-pressure refrigerant separated into the gas and liquid by the accumulator 29 is guided to the low-pressure conduit 42 through the first suction pipe 30*a*. The low-pressure refrigerant in the low-pressure conduit 42 is guided to the four-way selector valve 40 via the electromagnetic on-off valve 35 and sucked into the second cylinder chamber 14*b* through the first conduit 43. Differential pressure is thus generated between the leading end and trailing end of the blade 16*b* in the second cylinder chamber 14*b*. The leading end of the blade 16*b* slidably contacts the eccentric roller 12*b*, allowing a normal compression operation to be performed in the second cylinder chamber 14*b*.

Figure 8:
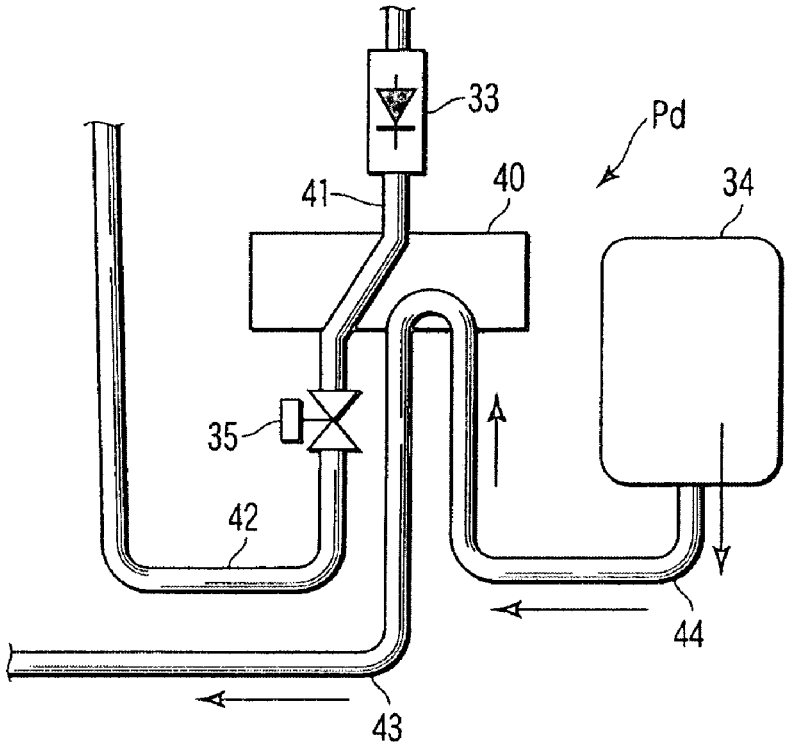
FIG. 8 is a diagram illustrating the flow of a refrigerant through the high-pressure refrigerant introducing mechanism during low-capacity operation according to the embodiment shown in FIG. 7.

As shown in FIG. 8, to switch the compressor to the low-capacity operation, control is performed such that the four-way selector valve 40 is switched, while the electromagnetic on-off valve 35 is closed. Thus, in the four-way selector valve 40, the high-pressure conduit 41 and the low-pressure conduit 42 communicate with each other, while the first conduit 43 and the second conduit 44 communicate with each other.

The high-pressure refrigerant divergently flowing to the high-pressure conduit 41 is guided to the low-pressure conduit 42 via the second check valve 33 and the four-way selector valve 40. However, since the electromagnetic on-off valve 35 is closed, the further flow of the high-pressure refrigerant is inhibited. The high-pressure refrigerant is thus ineffective on the refrigerating cycle.

On the other hand, the high-pressure refrigerant stored in the storage container 34 flows out of the storage container 34 and is guided to the first conduit 43 via the second conduit 44 and the four-way selector valve 40. The high-pressure refrigerant is then guided to the second cylinder chamber 14*b*, which is thus set to have the high-pressure atmosphere. No differential pressure is generated between the leading end and trailing end of the blade 16*a*, provided in the cylinder chamber 14*b*. This results in the non-compression operation condition.

Figure 9:
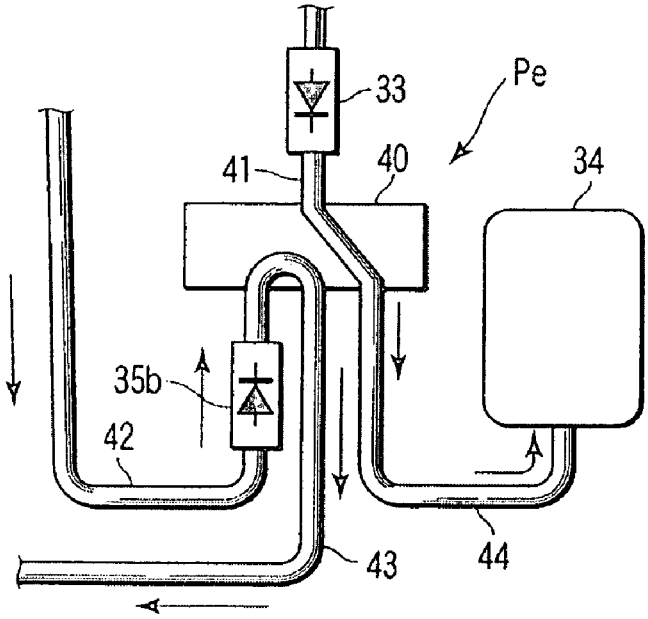
FIG. 9 is a diagram showing the flow of the refrigerant through the high-pressure refrigerant introducing mechanism during high- and low-capacity operation according to further another embodiment.
Figure 10:
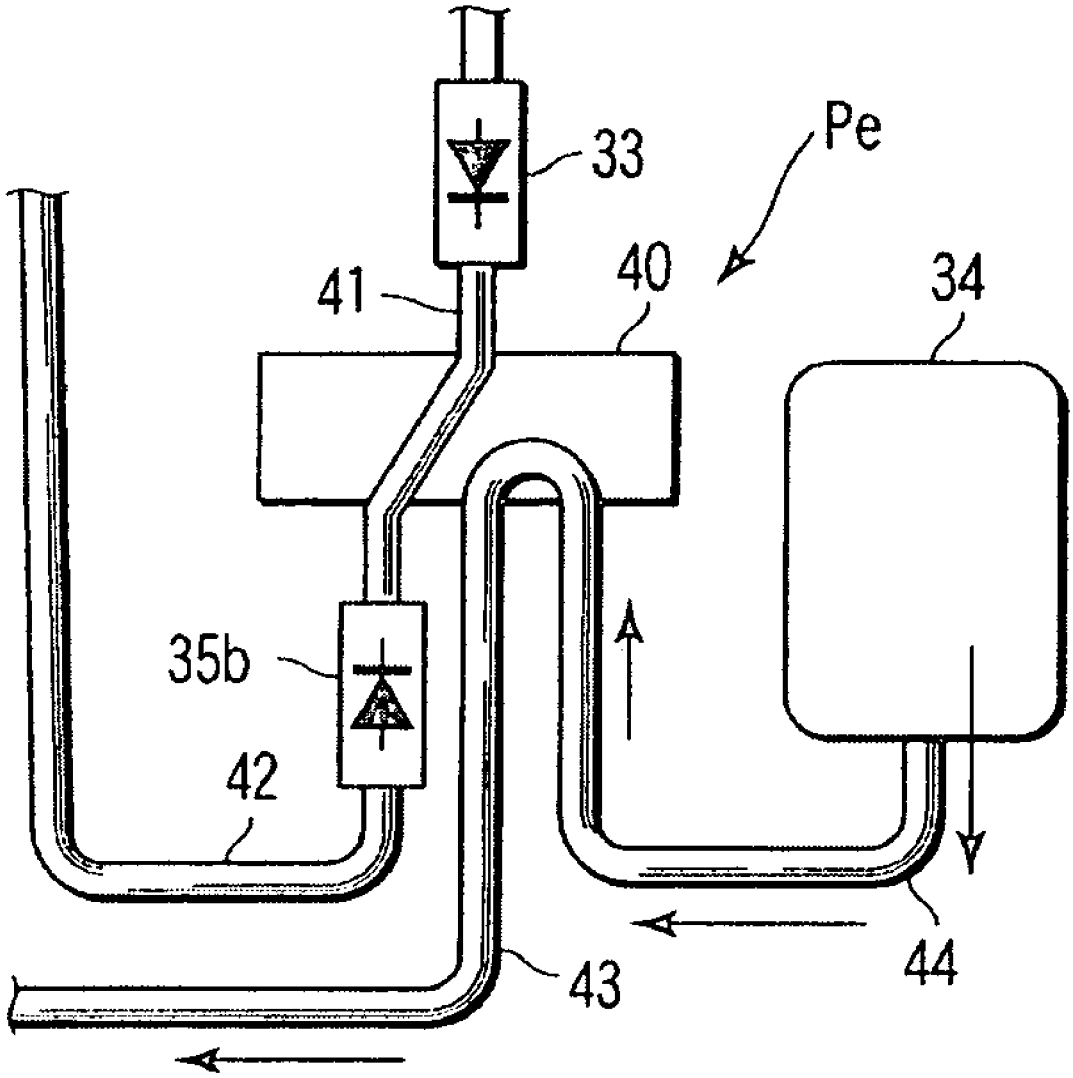
FIG. 10 is a diagram showing the flow of the refrigerant through the high-pressure refrigerant introducing mechanism during high- and low-capacity operation according to further another embodiment.

A high-pressure refrigerant introducing mechanism Pe as shown in FIGS. 9 and 10 may be used. That is, a third check valve 35*b* is provided in place of the electromagnetic on-off valve 35, provided in the low-pressure conduit 42.

FIG. 9 shows the high-capacity operation in which the high-pressure refrigerant guided through the high-pressure conduit 41 via the second check valve 33 is guided to the storage container 34 through the second conduit 44 for storage. The low-pressure refrigerant is guided from the accumulator 29 to the second cylinder 14*b* through the first conduit 43 via the third check valve 35*b* and the four-way selector valve 40. Differential pressure is thus generated between the leading end and trailing end of the blade 16*a*.

FIG. 10 shows the low-capacity operation in which the four-way selector valve 40 is switchably controlled so as to allow the third check valve 35*b* to inhibit the further flow of the high-pressure refrigerant guided from the high-pressure conduit 41 to the four-way selector valve 40 via the second check valve 33. The high-pressure refrigerant is thus ineffective on the refrigerating cycle.

On the other hand, the high-pressure refrigerant filling the storage container 34 is guided to the second cylinder chamber 14*b* via the second conduit 44, the four-way selector valve 40, and the first conduit 43. The second cylinder 14*b* is thus set to have the high-pressure atmosphere, preventing differential pressure from being generated between the leading end and trailing end of the blade 16*b*, provided in the cylinder chamber 14*b*. This results in the non-compression operation condition.

In any case, switchably controlling the four-way selector valve 40 enables the high-capacity operation to be switched to the low-capacity operation. This allows the above-described effects to be produced.

In the above-described high-pressure refrigerant introducing mechanisms P to Pd, the high-pressure refrigerant guided from the closed case 1 to the discharge pipe 25 is partly divergently guided to high-pressure introducing pipe 32 (or high-pressure conduit 41). However, the present invention is not limited to this. For example, the high-pressure introducing pipe 32 (or high-pressure conduit 41) may be connected to the closed case 1 instead of the discharge pipe 25 so as to guide part of the high-pressure gas filling the closed case 1.

Description has been given of the 2-cylinder type closed compressor R applied to the refrigerating cycle apparatus for air conditioning. The present invention is not limited to this. For example, the closed compressor may be applied to a refrigerating cycle apparatus for refrigeration or a closed container comprising three or more cylinders may be used.

The present invention is not limited to the above-described embodiments proper. In implementation, the components may be varied without departing from the spirit of the present invention. Various inventions can be formed by appropriately combining a plurality of the components disclosed in the above-described embodiments.

The present invention is effective for allowing the compression operation to be performed so that the capacity is variable depending on the difference in load and enabling the high-capacity operation condition to be stably switched to the low-capacity operation condition, preventing a possible noise.

What is claimed is:

1. A closed compressor comprising a closed case, an electric motor section accommodated in the closed case, a first compression mechanism section coupled to the electric motor section, and a second compression mechanism section coupled to the electric motor section, wherein:

each of the first and second compression mechanism sections comprises a cylinder comprising a cylinder chamber eccentrically rotatably accommodating a roller and a blade provided in the cylinder and having a leading end pressed and biased so as to abut against a peripheral surface of the roller to divide the cylinder chamber into two parts in a direction in which the roller rotates;

the second compression mechanism is provided with a high-pressure refrigerant introducing mechanism for guiding a high-pressure refrigerant into the cylinder chamber and separating the blade from the roller in the second compression mechanism section, and the compressor is configured to switch between a high-capacity operation in which all the compression mechanism sections perform a compression operation and a low-capacity operation in which the blade in the second compression mechanism section is separated from the roller and thus prevented from performing the compression operation, depending on a difference in load, and the high-pressure refrigerant introducing mechanism comprises a high-pressure refrigerant storage section storing the high-pressure refrigerant.

2. The closed compressor according to claim 1, wherein the high-pressure refrigerant introducing mechanism comprises:

a high-pressure introducing pipe, one end of which is in communication with a high-pressure side of a refrigerating cycle including the closed case, and the other end of which is in communication with the cylinder chamber in the second compression mechanism section, wherein the high-pressure refrigerant storage section is provided in the high-pressure introducing pipe; and fluid control valves are provided in the high-pressure introducing pipe upstream and downstream of the high-pressure refrigerant storage section.

3. A refrigerating cycle apparatus comprises the closed compressor according to claim 2, a condenser, an expansion device, and an evaporator to constitute a refrigerating cycle circuit.

4. The closed compressor according to claim 1, wherein the high-pressure refrigerant introducing mechanism comprises:

a four-way selector valve, a high-pressure introducing pipe allowing the four-way selector valve to communicate with the high-pressure side of the refrigerating cycle including the closed case, a low-pressure conduit allowing the four-way selector valve to communicate with a low-pressure side of the refrigerating cycle, a first conduit allowing the four-way selector valve to communicate with the cylinder chamber in the second compression mechanism section, and a second conduit allowing the four-way selector valve to communicate with the high-pressure refrigerant storage section, wherein the four-way selector valve allows the high-pressure conduit to communicate with the second conduit during a high-capacity operation and allows the first conduit to communicate with the second conduit during a low-capacity operation.

5. A refrigerating cycle apparatus comprises the closed compressor according to claim 4, a condenser, an expansion device, and an evaporator to constitute a refrigerating cycle circuit.

6. A refrigerating cycle apparatus-comprises the closed compressor according to claim 1, a condenser, an expansion device, and an evaporator to constitute a refrigerating cycle circuit.

* * * * *